US009171498B2

(12) United States Patent
Park

(10) Patent No.: US 9,171,498 B2
(45) Date of Patent: Oct. 27, 2015

(54) ORGANIC LIGHT EMITTING DIODE DISPLAY DEVICE AND METHOD FOR DRIVING THE SAME

(71) Applicant: LG DISPLAY CO., LTD., Seoul (KR)

(72) Inventor: Ilkwon Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 103 days.

(21) Appl. No.: 14/093,354

(22) Filed: Nov. 29, 2013

(65) Prior Publication Data

US 2014/0152708 A1 Jun. 5, 2014

(30) Foreign Application Priority Data

Nov. 30, 2012 (KR) ..... 10-2012-0138211

(51) Int. Cl.
*G09G 3/30* (2006.01)
*G09G 3/32* (2006.01)

(52) U.S. Cl.
CPC ..... *G09G 3/3208* (2013.01); *G09G 2300/0452* (2013.01); *G09G 2340/06* (2013.01); *G09G 2360/16* (2013.01)

(58) Field of Classification Search
CPC ..... G09G 3/3291; G09G 3/2003; G09G 3/20; G09G 3/32; G09G 3/36
USPC ..... 345/76–98, 204–215, 690
See application file for complete search history.

(56) References Cited

U.S. PATENT DOCUMENTS

2013/0070007 A1* 3/2013 Park et al. ..... 345/694

FOREIGN PATENT DOCUMENTS

CN 101702304 A 5/2010

OTHER PUBLICATIONS

CN 101702304 A; Dai Wenzhi; Liu, Jialin; Mo Qineng; Peng Jialing; Qiu Xianjun (Inventors). CPT Display Technology (Fujian) Ltd.; Chunghwa Picture Tubes Ltd (Assignees). (Published May 5, 2010).*

* cited by examiner

*Primary Examiner* — Vijay Shankar
(74) *Attorney, Agent, or Firm* — Birch, Stewart, Kolasch & Birch, LLP

(57) ABSTRACT

An organic light emitting diode display device can include a display panel in which data lines and gate lines intersect each other; an image processing circuit converting a first digital image data including a plurality of color digital data into any one of a second digital image data including the plurality of color digital data and a first white digital data and a third digital image data including a plurality of color conversion digital data that converts the plurality of color digital data and a second white digital data according to whether the first digital image data is included in a first gray scale region or a second gray scale region which is higher than the first gray scale region; and a data driving circuit converting the second digital image data into data voltages and supplying the data voltages to the data lines.

18 Claims, 5 Drawing Sheets

ORGANIC LIGHT EMITTING DIODE DISPLAY DEVICE AND METHOD FOR DRIVING THE SAME

This application claims the priority benefit of Korean Patent Application No. 10-2012-0138211 filed on Nov. 30, 2012, which is incorporated herein by reference for all purposes as if fully set forth herein.

BACKGROUND

1. Field

The present invention relates to an organic light emitting diode display device and a method for driving the same.

2. Related Art

In accordance with the advancement of an information-oriented society, a demand for a displaying device for displaying an image has increased in various types. Accordingly, a flat panel display (FPD) device such as a liquid crystal display (LCD), a plasma display panel (PDP), or an organic light emitting diode (OLED) has been recently used. Among these flat panel display devices, the OLED is driven at a low voltage and has a thin type, an excellent viewing angle, and a fast response speed.

The OLED includes a plurality of pixels arranged in a matrix form. Each pixel includes a scan thin film transistor (TFT) supplying a data voltage to a data line in response to a scan signal from a scan line and a driving TFT controlling an amount of current that is supplied to the OLED according to the data voltage supplied to a gate electrode. In detail, the driving TFT controls the amount of current flowing in the OLED from a high potential voltage supplied to the each of the pixels, thereby making it possible to control an amount of emission of the OLED.

Recently, each of the pixels of the OLED display device includes a white subpixel in addition to a red subpixel, a green subpixel, and a blue subpixel. In case of the white subpixel, since the color filter is not required, the white subpixel has a higher transmissivity than the red subpixel, the green subpixel, and the blue subpixel. Therefore, the OLED display device including the white subpixel may reduce a red light, a green light, and a blue light output from the red subpixel, the green subpixel, and the blue subpixel, respectively, due to a white light output from the white subpixel, thereby making it possible to significantly reduce power consumption.

However, when the OLED display device including the white subpixel displays a digital video data for a low gray scale region, even if the white light is finely adjusted, a color distortion is easily generated due to an intensity of the white light output from the white subpixel. As a result, the OLED display device including the white subpixel has a difficulty in uniformly maintaining a color temperature for all gray scale. When the digital video data of 8 bits is input to the OLED display device, the gray scale may be represented by a value ranging from 0 to 255. In this case, the low gray scale region indicates a black gray scale region having a value ranging from 0 to 63.

SUMMARY

An organic light emitting diode display device according to an embodiment of the present invention comprises: a display panel in which data lines and gate lines intersect each other; an image processing circuit converting a first digital image data including a plurality of color digital data into any one of a second digital image data including the plurality of color digital data and a first white digital data, and a third digital image data including a plurality of color conversion digital data that converts the plurality of color digital data and a second white digital data according to whether the first digital image data is included in a first gray scale region or a second gray scale region which is higher than the first gray scale region; a data driving circuit converting the second digital image data into data voltages and supplying the data voltages to the data lines; and a gate driving circuit sequentially supplying gate pulses synchronized with the data voltages to the gate lines.

A method for driving an organic light emitting diode display device according to an embodiment of the present invention comprises: in a method for driving an organic light emitting diode display device provided with a display panel in which data lines and gate lines intersect each other, converting a first digital image data including a plurality of color digital data into any one of a second digital image data including the plurality of color digital data and a first white digital data and a third digital image data including a plurality of color conversion digital data that converts the plurality of color digital data and a second white digital data according to whether the first digital image data is included in a first gray scale region or a second gray scale region which is higher than the first gray scale region (step 1); converting the second digital image data into data voltages and supplying the data voltages to the data lines of the display panel (step 2); and sequentially supplying gate pulses synchronized with the data voltages to the gate lines of the display panel (step 3).

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 1:
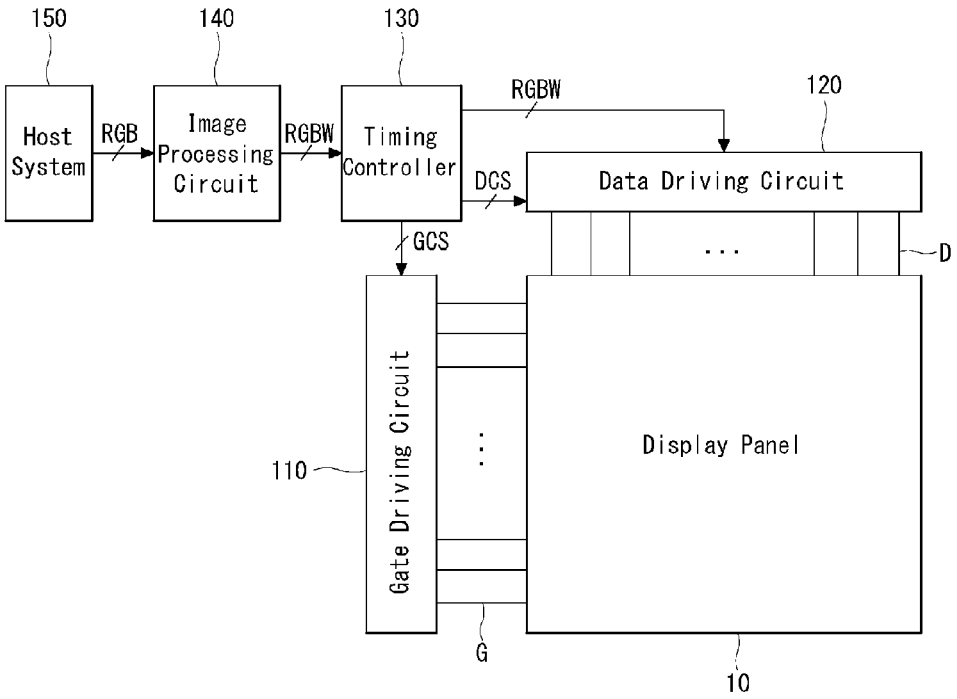
FIG. 1 is a block view schematically showing an organic light emitting diode display device according to an exemplary embodiment of the present invention.

FIG. 1 is a block view schematically showing an organic light emitting diode display device according to an exemplary embodiment of the present invention. Referring to FIG. 1, the display device according to the exemplary embodiment of the present invention includes a display panel 10, a gate driving circuit 110, a data driving circuit 120, a timing controller 130, an image processing circuit 140, a host system 150, and the like.

The display panel 10 is provided with data lines D and gate lines G formed to intersect with each other, and a pixel array that pixels are arranged in a matrix form is formed in an intersecting region of the data lines D and the gate lines G. Each of the pixels of the display panel 10 is includes a switching thin film transistor (TFT), a driving TFT, an organic light emitting diode element, and at least one capacitor. The each of the pixels of the display panel 10 displays an image by controlling a current flowing in the organic light emitting diode element using the switching TFT and the driving TFT. In detail, the driving TFT may control an amount of current flowing in the organic light emitting diode (OLED) from a high potential voltage supplied to the each of the pixels, whereby an amount of emission of the OLED may also be controlled. The display panel 10 may display the image in a type such as a bottom emission type or a top emission type according to the pixel structure.

The each of the pixels of the display panel 10 may include a plurality of color subpixels and a white subpixel. For example, the each of the pixels P of the display panel 10 may include a red subpixel RP, a green subpixel GP, a blue subpixel BP, and a white subpixel WP as shown in FIGS. 5A to 6B. The red subpixel RP outputs a red light using a red OLED element or may output a red light using a white OLED element and a red color filter. The green subpixel GP outputs a green light using a green OLED element or may output a green light using a white OLED element and a green color filter. The blue subpixel BP outputs a blue light using a blue OLED element or may output a blue light using a white OLED element and a blue color filter. The white subpixel WP outputs a white light using a white OLED element.

Figure 5A:
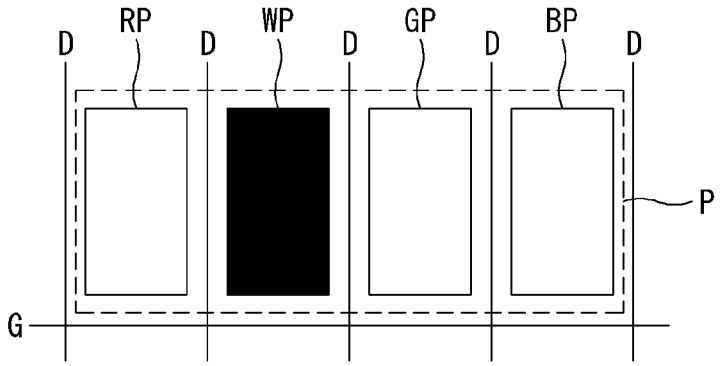
FIGS. 5A and 5B are views showing pixels when determined as a first gray scale region.
Figure 5B:
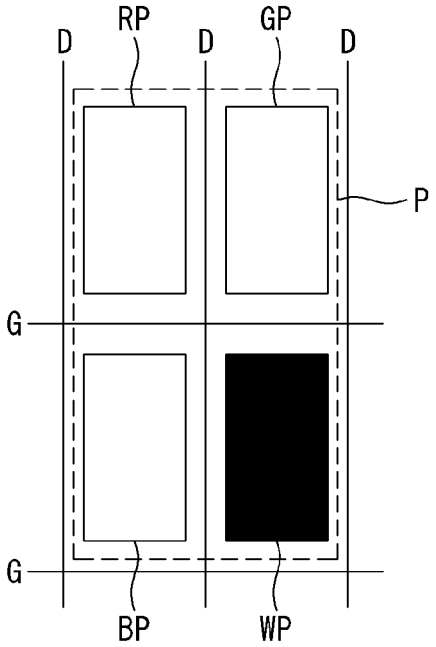
Figure 6A:
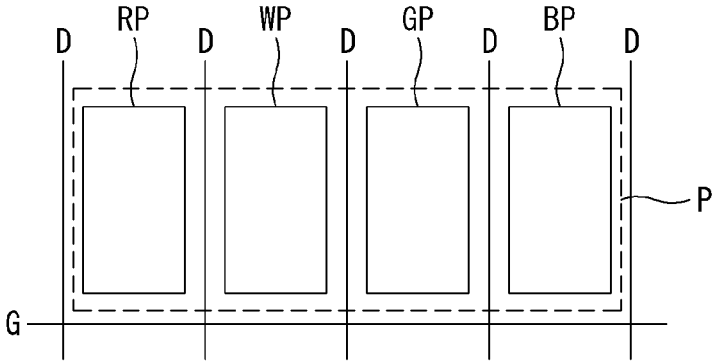
FIGS. 6A and 6B are views showing pixels when determined as a second gray scale region.
Figure 6B:
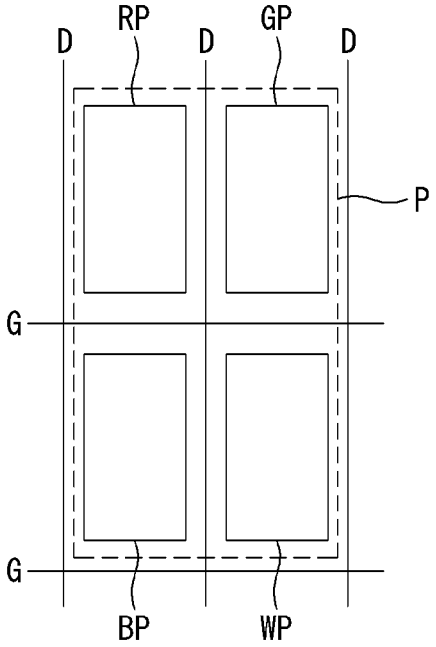

The red subpixel RP, the green subpixel GP, the blue subpixel BP, and the white subpixel WP may be arranged in a horizontal direction as shown in FIGS. 5A and 6A. Although FIGS. 5A and 6A show a case in which the red subpixel RP, the white subpixel WP, the green subpixel GP, and the blue subpixel BP are sequentially arranged, the present invention is not limited thereto. In addition, the red subpixel RP, the green subpixel GP, the blue subpixel BP, and the white subpixel WP may be arranged in a rectangular shape as shown in FIGS. 5B and 6B. Although FIGS. 5B and 6B show a case in which the red subpixel RP and the green subpixel GP are arranged in any one row and the blue subpixel BP and the white subpixel WP are arranged in the other one row, the present invention is not limited thereto.

The data driving circuit 120 includes a plurality of source drive integrated circuits (ICs). The source drive ICs receive a second digital image data RGBW or a third digital image data R'G'B'W' from the timing controller 130. The source drive ICs receive gamma reference voltages from a gamma reference voltage supplying circuit and calculate gamma compensation voltages using a voltage divider circuit. The source drive ICs convert the second digital image data (RGBW) or the third digital image data (R'G'B'W') into an analog data voltage using the gamma compensation voltages according to a source timing control signal from the timing controller 130 and supply the converted data voltage to the data lines D of the display panel 10. The source drive ICs may be mounted on source TCP, and the source TCP may be bonded to the display panel 10 and a source printed circuit board by a tape auto bonding (TAB) process. In addition, the source drive ICs may be directly bonded to the display panel 10 by a chip on glass (COG) process.

The data driving circuit 110 includes a plurality of gate drive integrated circuits (ICs). The gate drive ICs perform the synchronization of at least one gate pulse for controlling the at least one switching TFT of the each pixel and the gate voltage to supply the gate pulses to the gate lines G of the display panel 10. The gate drive ICs may be mounted on a gate tape carrier package (TCP) and the gate TCP may be bonded to the display panel 10 by a tape automated bonding (TAB) process. In addition, the gate drive ICs may be directly formed together with a pixel array by a gate in panel (GIP) process.

The timing controller 130 receives a second digital image data RGBW or a third digital image data R'G'B'W' and a timing signal from the image processing circuit 140. The timing signal may include a vertical synchronization signal, a horizontal synchronization signal, a data enable signal, a dot clock, and the like. The timing controller 130 generates the timing control signals for controlling an operation timing of the gate driving circuit 110 and the data driving circuit 120 based on the timing signal. The timing control signal includes a gate timing control signal (GCS) for controlling the operation timing of the gate driving circuit 110 and a data timing control signal (DCS) for controlling the operation timing of the data driving circuit 120. The timing control circuit outputs the gate timing control signal GCS to the gate driving circuit 110, and the second digital image data RGBW or the third digital image data R'G'B'W' and the data timing control signal DCS to the data driving circuit 120.

The image processing circuit 140 receives the first digital image data RGB and the timing signal from the host system 150. The image processing circuit 140 converts the first digital image data RGB into the second digital image data RGBW or the third digital image data R'G'B'W' to output the converted digital image data to the timing controller 130.

The first digital image data RGB includes the plurality of color digital data. For example, the first digital image data RGB may include the red digital data R to be supplied to the red subpixel RP, the green digital data G to be supplied to the green subpixel GP, and the blue digital data B to be supplied to the blue subpixel BP. The second digital image data RGBW includes the plurality of color digital data and the first white digital data. For example, the second digital image data RGBW may include the red digital data R, the green digital data G, the blue digital data B, and the first white digital data W to be supplied to the white subpixel WP. The red digital data R, the green digital data G, the blue digital data B of the first digital image data RGB are the same as the red digital data R, the green digital data G, the blue digital data B of the second digital image data RGBW. The third digital image data R'G'B'W' includes the plurality of color conversion digital data and the second white digital data. For example, the third digital image data R'G'B'W' may include a red conversion digital data R', a green conversion digital data G', a blue conversion digital data B', and a second white digital data W' to be supplied to the white subpixel WP. The plurality of color conversion digital data may be calculated by converting the plurality of color digital data. In detail, the image processing circuit 140 converts the first digital image data RGB into the any one of the second digital image data RGBW and the third digital image data R'G'B'W' according to whether the first digital image data RGB is included the first gray scale region or the second gray scale region. The detailed description of the image processing circuit 140 will be described below with reference to FIGS. 2 and 3. The image processing circuit 140 outputs the second digital image data RGBW or the third digital image data R'G'B'W' and the timing signal to the timing controller 130. The image processing circuit 140 may be designed to embed in the timing controller 130 or the host system 160.

The host system 150 may include a system on chip in which a scaler is embedded therein in order to convert to a data format with resolution suitable to display the first digital image data RGB input from an external video source device on the display panel 10. The host system 150 supplies the first digital image data RGB and the timing signals to the image processing circuit 140 through a low voltage differential signaling (LVDS) interface, a transition minimized differential signaling (TMDS) interface, or the like.

Figure 2:
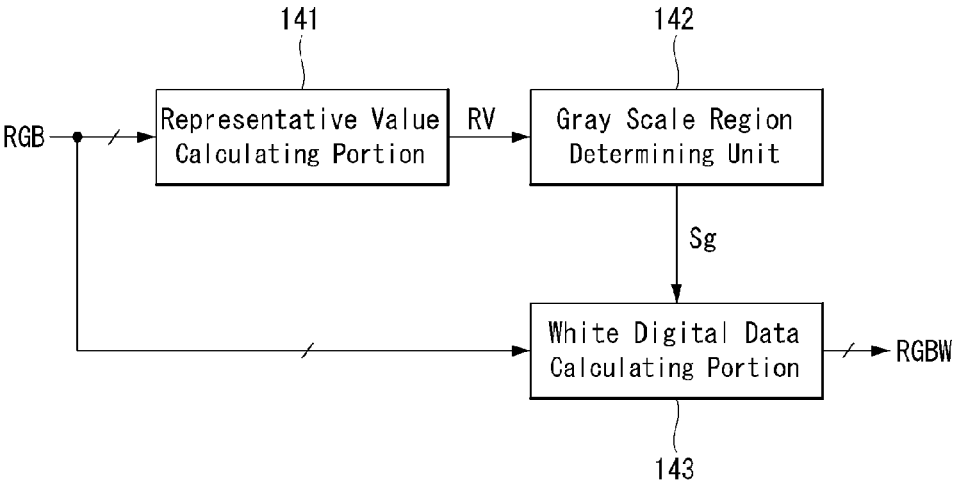
FIG. 2 is a detailed block view showing an image processing circuit of FIG. 1.
Figure 3:
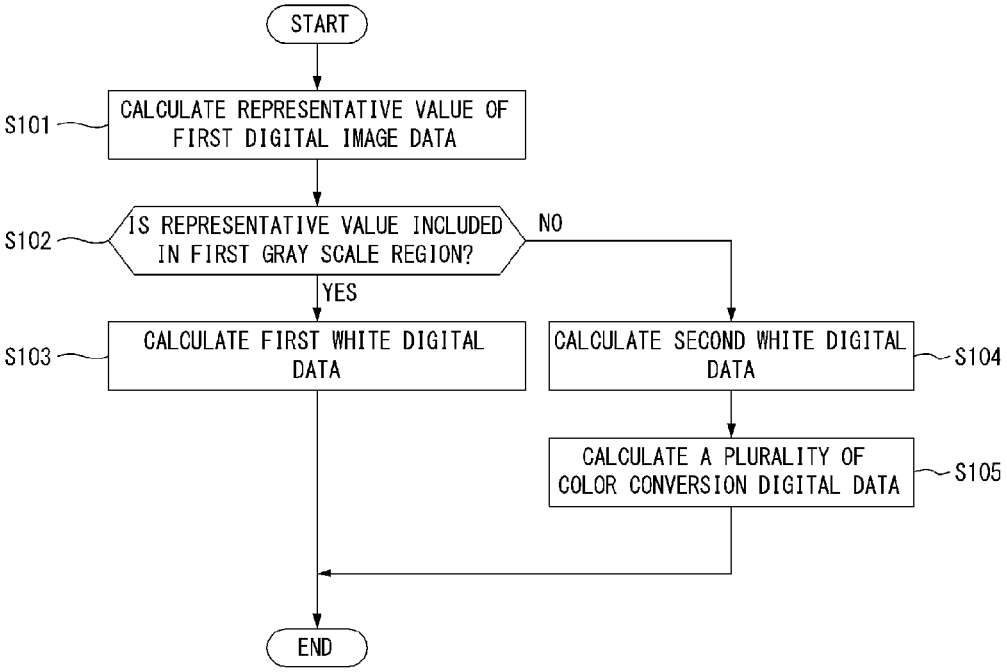
FIG. 3 is a flowchart showing an image processing method of an image processing circuit of FIG. 2.

FIG. 2 is a detailed block view showing an image processing circuit of FIG. 1. FIG. 3 is a flowchart showing an image processing method of an image processing circuit of FIG. 2. Referring to FIG. 2, the image processing circuit 140 according to the exemplary embodiment of the present invention includes a representative value calculating portion 141, a gray scale region determining unit 142, and a white digital data calculating portion 143. Hereinafter, the image processing method of the image processing circuit 140 will be described in detail with reference to FIGS. 2 and 3.

First, the representative value calculating portion 141 receives the first digital image data RGB from the host system 150. The first digital image data RGB may include the plurality of color digital data, that is, the red digital data R, the green digital data G, and the blue digital data B. The representative value calculating portion 141 calculates a representative value RV of the first digital image data RGB by analyzing the first digital image data RGB.

The representative value calculating portion 141 may calculate the minimum value of the red digital data R, the green digital data G, and the blue digital data B of the first digital image data RGB as the representative value RV of the first digital image data RGB by the following Equation 1.

$$RV=\min(R,G,B) \quad \text{[Equation 1]}$$

In addition, the representative value calculating portion 141 may calculate an average value of the red digital data R, the green digital data G, and the blue digital data B of the first digital image data RGB as the representative value RV of the first digital image data RGB by the following Equation 2.

$$RV=\text{avg}(R,G,B) \quad \text{[Equation 2]}$$

In addition, the representative value calculating portion 141 may calculate a median of the red digital data R, the green digital data G, and the blue digital data B of the first digital image data RGB as the representative value RV of the first digital image data RGB by the following Equation 3.

$$RV=\text{median}(R,G,B) \quad \text{[Equation 3]}$$

In addition, the representative value calculating portion 141 may calculate luminance Y of the first digital image data RGB as the representative value RV of the first digital image data RGB by the following Equation 4.

$$Y = 16 + \frac{1}{256}(65.783 \times R + 129.057G + 25.064B) \quad \text{[Equation 4]}$$

In the case of calculating the representative value RV of the first digital image data RGB using Equation 1, a probability that the representative value RV of the first digital image data RGB is included in the first gray scale region GA1 increases as compared to the case of calculating the representative value RV of the first digital image data RGB using the above Equations 2 to 4. (S101)

Second, the gray scale determining portion 142 determines whether the representative value RV of the first digital image data RGB is included the first gray scale region GA1 or the second gray scale region GA2.

Figure 4:
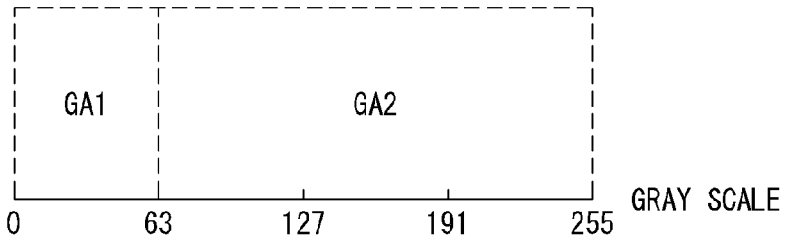
FIG. 4 is a view showing a first gray scale region and a second gray scale region.

FIG. 4 is a view showing a first gray scale region and a second gray scale region. FIG. 4 mainly describes the case in which the first digital image data RGB is 8 bits. In the case in which the first digital image data RGB is 8 bits, the gray scale level of the first digital image data RGB may be represented by a value ranging from 0 to 255 as shown in FIG. 4. Referring to FIG. 4, it is know in that 0 to 63 gray scale levels are black gray scale region, 64 to 191 gray scale levels are gray gray-scale region, and 192 to 255 gray scale levels are white gray scale region. In FIG. 4, although the first gray scale region GA1 shows the black gray scale region of the 0 to 63 gray scale levels, the present invention is not limited thereto. The second gray scale region GA2 is gray scale region higher than the first gray scale region GA1, although FIG. 4 shows the gray and white gray scale regions of the value ranging from 64 to 255, the present invention is not limited thereto.

The gray scale region determining unit 142 may determine that the representative value RV of the first digital image data RGB is included in the first gray scale region GA1 when the representative value RV of the first digital image data RGB is a predetermined threshold TH or less. In this case, the predetermined threshold value TH may be set to the maximum value of the first gray scale region GA1. For example, in FIG. 4, the predetermined value TH may be set to 63. The gray scale region determining unit 142 may output a gray scale division signal Sg of a first logic level to the white digital data calculating portion 143 when the representative value RV of the first digital image data RGB is a predetermined threshold TH or less. In addition, the gray scale region determining unit 142 may determine that the representative value RV of the first digital image data RGB is included in the second gray scale region GA2 when the representative value RV of the first digital image data RGB is more than the predetermined threshold TH. The gray scale region determining unit 142 may output a gray scale division signal Sg of a second logic level to the white digital data calculating portion 143 when the representative value RV of the first digital image data RGB is more than the predetermined threshold TH. (S102)

Third, the white digital data calculating portion 143 receives the first digital image data RGB from the host system 150, and the gray scale division signal Sg from the gray scale region determining unit 142. In detail, the white digital data calculating portion 143 calculates any one of the first white digital data W and the second white digital data W' according to whether the first digital image data RGB is included the first gray scale region GA1 or the second gray scale region GA2.

The white digital data calculating portion 143 calculates the first white digital data W when the gray scale division signal Sg of the first logic level is input. The white digital data calculating portion 143 may allocate the minimum gray scale value to the first white digital data W. As shown in FIG. 4, the minimum gray scale value may be set to 0. The white digital data calculating portion 143 outputs the second digital image data RGBW including the red digital data R, the green digital data G, and the blue digital data B of the first digital image data RGB and the first white digital data W to the timing controller 130 when the gray scale division signal Sg of the first logic level is input. (S103)

Fourth, the white digital data calculating portion 143 calculates the second white digital data W' using the red digital data R, the green digital data G, and the blue digital data B when the gray scale division signal Sg of the second logic level is input. For example, the white digital data calculating portion 143 may calculate the minimum value of the red digital data R, the green digital data G, and the blue digital data B of the first digital image data RGB as the second white digital data W' by the following Equation 5.

$$W'=\min(R,G,B) \quad \text{[Equation 5]}$$

Then, the white digital data calculating portion 143 calculates the red conversion digital data R', the green conversion digital data G', and the blue conversion digital data B' by subtracting the first white digital data W from each of the red digital data R, the green digital data G, and the blue digital data B by the following Equation 6.

$$\begin{bmatrix} R' = R - W \\ G' = G - W \\ B' = B - W \\ W = W \end{bmatrix} \quad \text{[Equation 6]}$$

Meanwhile, the white digital data calculating portion 143 is not limited to the white data calculating method described with reference to the above Equations 5 and 6. That is, the white digital data calculating portion 143 may calculate the second white digital data W' by known another white digital data calculating method. The white digital data calculating portion 143 outputs the third digital image data R'G'B'W' including the red conversion digital data R', the green conversion digital data G', and the blue conversion digital data B' and the second white digital data W' to the timing controller 130 when the gray scale division signal Sg of the second logic level is input. (S104 and S105)

FIGS. 5A and 5B are views showing pixels when determined as the first gray scale region. FIGS. 6A and 6B are views showing pixels when determined as the second gray scale region. Referring to FIGS. 5A to 6B, the image processing circuit 140 converts the first digital image data RGB into the any one of the second digital image data RGBW and the third digital image data R'G'B'W' according to whether the first digital image data RGB is included the first gray scale region GA1 or the second gray scale region GA2.

Referring to FIGS. 5A and 5B, the image processing circuit 140 outputs the second digital image data RGBW including the red digital data R, the green digital data G, and the blue digital data B and the first white digital data W when the first digital image data RGB is included the first gray scale region GA1. Therefore, a pixel P to which the second digital image data RGBW is supplied displays the gray scale corresponding to the first gray scale region GA1. Accordingly, the white subpixel WP of the pixel P to which the second digital image data RGBW is supplied displays a peak black gray scale level as shown in FIGS. 5A and 5B. That is, the pixel P to which the second digital image data RGBW is supplied displays the image using the red subpixel RP, the green subpixel GP, and the blue subpixel BP without using the white subpixel WP.

Referring to FIGS. 6A and 6B, the image processing circuit 140 outputs the third digital image data R'G'B'W' including the red conversion digital data R', the green conversion digital data G', and the blue conversion digital data B' and the second white digital data W' when the first digital image data RGB is included the second gray scale region GA2. Therefore, a pixel P to which the third digital image data R'G'B'W' is supplied displays the gray scale corresponding to the second gray scale region GA2. Therefore, the white subpixel WP of the pixel P to which the third digital image data R'G'B'W' is supplied does not display the peak black gray scale level as shown in FIGS. 6A and 6B. That is, the pixel P to which the third digital image data R'G'B'W' is supplied displays the image using the red subpixel RP, the green subpixel GP, and the blue subpixel BP and the white subpixel WP.

However, the image processing circuit 140 generates the red conversion digital data R', the green conversion digital data G', and the blue conversion digital data B' by subtracting the second white digital data W' from each of the red digital data R, the green digital data G, and the blue digital data B when the first digital image data RGB is included the second gray scale region GA2. Here, since the second white digital data W' is calculated as the minimum value of the red digital data R, the green digital data G, and the blue digital data B, at least one of the red conversion digital data R', the green conversion digital data G', and the blue conversion digital data B' may have the minimum gray scale value. That is, at least one of the red subpixel RP, the green subpixel GP, and the blue subpixel BP of the pixel P to which the third digital image data R'G'B'W' is supplied may display the peak black gray scale level. In this case, since a color temperature may cause the problem in the second gray scale region GA2, a color temperature adjustor which is to adjust the color temperature by adjusting the red conversion digital data R', the green conversion digital data G', and the blue conversion digital data B' may be included in the white digital data calculating portion 143. The color temperature adjustor maintains the color temperature by allowing the red conversion digital data R', the green conversion digital data G', and the blue conversion digital data B' not to have the minimum gray scale value.

Figure 7:
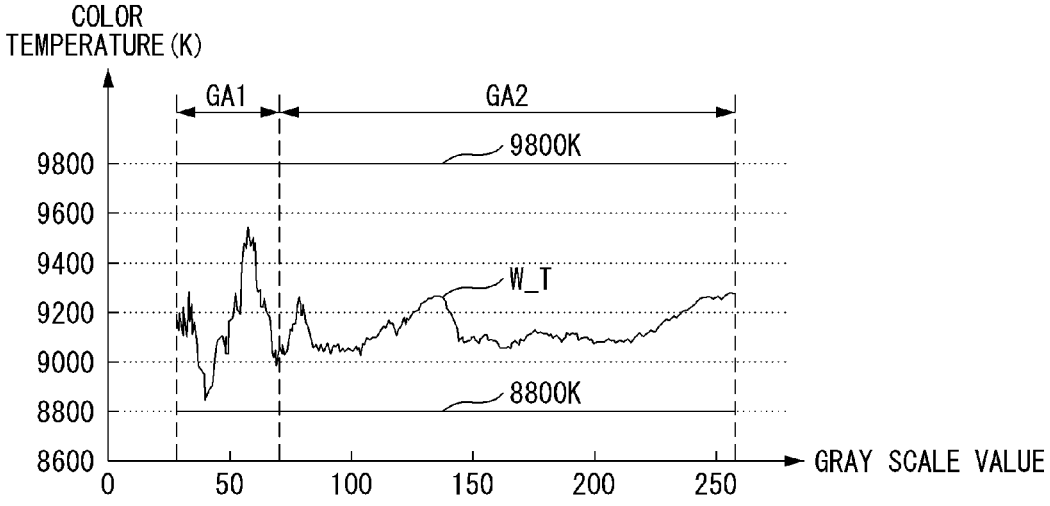
FIG. 7 is a view showing a color temperature for all gray scale of an organic light emitting diode display device according to an exemplary embodiment of the present invention.

FIG. 7 is a view showing a color temperature for all gray scale levels that an organic light emitting diode display device displays according to an exemplary embodiment of the present invention. In FIG. 7, x axis means the gray scale level and y axis means the color temperature (unit is Kelvin K). The gray scale level represented by the value ranging from 0 to 255 will be mainly described.

Referring to FIG. 7, the color temperature K in the first gray scale region GA1 is measured at 8800K to 9600K, and the color temperature K in the second gray scale region GA2 is measured at color temperature of 9000K to 9300K. A deviation of the color temperature K in the first gray scale region GA1 is larger than that of the second gray scale region GA2, but since the deviation is generated within 1000K, the deviation has not been largely problematic to a user. That is, the present invention outputs the second digital image data RGBW including the first white digital data W that the minimum gray scale value is allocated when the first digital image data RGB is included in the first gray scale region GA1, such that the pixel P to which the second digital image data RGBW is supplied displays the peak black gray scale level to the white subpixel WP. Therefore, the deviation of the color temperature K in the first gray scale region GA1 may be reduced within the 1000K.

As described above, since the present invention outputs the second digital image data including the first white digital data that the minimum gray scale value is allocated when the first digital image data is included in the first gray scale region, the pixel to which the second digital image data is supplied displays the image using the red subpixel, the green subpixel, and the blue subpixel without using the white subpixel. In addition, since the present invention outputs the second digital image data including the second white digital data calculated by using the plurality of color digital data when the first digital image data is included in the second gray scale region which is the gray scale region higher than the first gray scale region, the pixel to which the third digital image data is supplied displays the image using the red subpixel, the green subpixel, the blue subpixel, and the white subpixel. As a result, the present invention may uniformly maintain the color temperature in the all gray scale levels, such that the power consumption may be reduced.

In addition, although the image processing circuit 140 according to the exemplary embodiment of the present invention mainly describes the case in which is implemented in the organic light emitting diode (OLED) display device, the image processing circuit 140 may be applied to a flat panel display device such as a Liquid Crystal Display (LCD), a Field Emission Display (FED), a Plasma Display Panel (PDP), or the like.

Hereinabove, it will be apparent to those skilled in the art that various changes and modifications can be made without departing from the spirit and scope of the invention by the above mentioned description. Therefore, the present invention is not limited to the above mentioned detailed description and it should be defined by the appended claims.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display device comprising:

a display panel in which data lines and gate lines intersect each other;

an image processing circuit converting first digital image data including a plurality of color digital data into either second digital image data including the plurality of color digital data and first white digital data or third digital image data including a plurality of color conversion digital data that converts the plurality of color digital data and a second white digital data according to whether the first digital image data is included in a first gray scale region or a second gray scale region which is higher than the first gray scale region, wherein the image processing circuit includes:

a representative value calculating unit calculating a representative value by analyzing the first digital image data, a gray scale region determining unit determining whether the representative value is included in the first gray scale region or the second gray scale region, and a white digital data calculating unit allocating a minimum gray scale value to the first white digital data when the representative value is included in the first gray scale region, and calculating the second white digital data using the plurality of color digital data when the representative value is included in the second gray scale region;

a data driving circuit converting the second digital image data or the third digital image data into data voltages and supplying the data voltages to the data lines of the display panel; and a gate driving circuit sequentially supplying gate pulses synchronized with the data voltages to the gate lines.

2. The organic light emitting diode display device of claim 1, wherein the representative value calculating unit calculates the minimum value of the plurality of color digital data of the first digital image data as the representative value.

3. The organic light emitting diode display device of claim 1, wherein the representative value calculating unit calculates average value or median of the plurality of color digital data of the first digital image data as the representative value.

4. The organic light emitting diode display device of claim 1, wherein the representative value calculating unit calculates luminance of the first digital image data as the representative value.

5. The organic light emitting diode display device of claim 1, wherein the gray scale region determining unit determines that the representative value is included in the first gray scale region when it is a threshold value or less, and the representative value is included in the second gray scale region when it is more than the threshold value.

6. The organic light emitting diode display device of claim 1, wherein the white digital data calculating unit calculates the minimum value of the plurality of color digital data as the second white digital data when the representative value is included in the second gray scale region.

7. The organic light emitting diode display device of claim 6, wherein the white digital data calculating unit calculates the plurality of color conversion digital data by subtracting the second white digital data from each of the plurality of color digital data when the representative value is included in the second gray scale region.

8. The organic light emitting diode display device of claim 1, wherein the white digital data calculating unit outputs the second digital image data when the representative value is included in the first gray scale region and the third digital image data when the representative value is included in the second gray scale region.

9. A method for driving an organic light emitting diode display device, the method comprising:

in a method for driving an organic light emitting diode display device provided with a display panel in which data lines and gate lines intersect each other, converting first digital image data including a plurality of color digital data into either second digital image data including the plurality of color digital data and first white digital data or third digital image data including a plurality of color conversion digital data that converts the plurality of color digital data and second white digital data according to whether the first digital image data is included in a first gray scale region or a second gray scale region which is higher than the first gray scale region (step 1), wherein the step 1 includes:

calculating a representative value by analyzing the first digital image data (step 1-1), determining whether the representative value is included in the first gray scale region or the second gray scale region (step 1-2), and allocating a minimum gray scale value to the first white digital data when the representative value is included in the first gray scale region, and calculating the second white digital data using the plurality of color digital data when the representative value is included in the second gray scale region (step 1-3);

converting the second digital image data or the third digital image data into data voltages and supplying the data voltages to the data lines of the display panel (step 2); and sequentially supplying gate pulses synchronized with the data voltages to the gate lines of the display panel (step 3).

10. The method of claim 9, wherein the step 1-1 calculates the minimum value of the plurality of color digital data of the first digital image data as the representative value.

11. The method of claim 9, wherein the step 1-1 calculates mean or median of the plurality of color digital data of the first digital image data as the representative value.

12. The method of claim 9, wherein the step 1-1 calculates luminance of the first digital image data as the representative value.

13. The method of claim 9, wherein the step 1-2 determines that the representative value is included in the first gray scale region when it is a threshold value or less, and the representative value is included in the second gray scale region when it is larger than the threshold value.

14. The method of claim 9, wherein the step 1-3 calculates the minimum value of the plurality of color digital data as the second white digital data when the representative value is included in the second gray scale region.

15. The method of claim 14, wherein the step 1-3 calculates the plurality of color conversion digital data by subtracting the second white digital data from each of the plurality of color digital data when the representative value is included in the second gray scale region.

16. The method of claim 15, wherein the step 1-3 outputs the second digital image data when the representative value is included in the first gray scale region and the third digital image data when the representative value is included in the second gray scale region.

17. An organic light emitting diode display device comprising:

a display panel in which data lines and gate lines intersect each other;

an image processing circuit converting first digital image data including a plurality of color digital data into either second digital image data including the plurality of color digital data and first white digital data or third digital image data including a plurality of color conversion digital data that converts the plurality of color digital data and second white digital data according to whether the first digital image data is included in a first gray scale region or a second gray scale region which is higher than the first gray scale region;

a data driving circuit converting the second digital image data or the third digital image data into data voltages and supplying the data voltages to the data lines of the display panel; and a gate driving circuit sequentially supplying gate pulses synchronized with the data voltages to the gate lines.

18. A method for driving an organic light emitting diode display device comprising:

in a method for driving an organic light emitting diode display device provided with a display panel in which data lines and gate lines intersect each other, converting first digital image data including a plurality of color digital data into either second digital image data including the plurality of color digital data and first white digital data or third digital image data including a plurality of color conversion digital data that converts the plurality of color digital data and second white digital data according to whether the first digital image data is included in a first gray scale region or a second gray scale region which is higher than the first gray scale region (step 1);

converting the second digital image data or the third digital image data into data voltages and supplying the data voltages to the data lines of the display panel (step 2); and sequentially supplying gate pulses synchronized with the data voltages to the gate lines of the display panel (step 3).

* * * * *